US005959827A

United States Patent [19]

Smith et al.

[11] Patent Number: 5,959,827

[45] Date of Patent: Sep. 28, 1999

[54] INTEGRATED LEAD SUSPENSION ELECTROSTATIC DISCHARGE PROTECTOR

[75] Inventors: Darrick T. Smith, San Jose; Timothy Scott Hughbanks, Morgan Hill, both of Calif.

[73] Assignee: International Business Machines Corporation, Armonk, N.Y.

[21] Appl. No.: 09/108,730

[22] Filed: Jul. 1, 1998

[51] Int. Cl.[6] ..... H05F 3/02

[52] U.S. Cl. ..... 361/212; 361/220

[58] Field of Search ..... 361/212, 220, 361/816, 818; 369/126, 99; 307/100; 174/51, 35

[56] References Cited

U.S. PATENT DOCUMENTS 4,837,657 6/1989 Belanger, Jr. et al. ..... 361/220
5,193,047 3/1993 Barratt et al. ..... 361/212
5,289,336 2/1994 Gagliano ..... 361/220
5,475,548 12/1995 Rudi et al. ..... 360/96.5
5,710,682 1/1998 Arya et al. ..... 360/106
5,812,357 9/1998 Johansen et al. ..... 361/212

*Primary Examiner*—Jeffrey Gaffin
*Assistant Examiner*—Kim Huynh
*Attorney, Agent, or Firm*—Douglas R. Millett; Andrew J. Dillon

[57] ABSTRACT

An electrically conductive grounding unit is situated between the integrated lead suspension and the tool block which is used to assemble it to the transducer head. The grounding unit grounds the uninsulated traces on the integrated lead suspension, thereby eliminating the danger of imparting static electricity to the transducer head during the assembly process. The grounding unit carries unwanted charges from the electrical traces on the suspension to the grounded tool block. The grounding unit is preferably fabricated from ceramic materials.

16 Claims, 4 Drawing Sheets

INTEGRATED LEAD SUSPENSION ELECTROSTATIC DISCHARGE PROTECTOR

TECHNICAL FIELD

This invention relates in general to protecting electronics against electrostatic discharge and in particular to a device for protecting an integrated lead suspension assembly against electrostatic discharge during the head gimbal assembly process.

BACKGROUND ART

Integrated lead suspensions (ILS) for computer hard disk drive head gimbal assemblies use electrical leads which are directly incorporated into the suspension body. Unfortunately, the conductive traces do not have any electrical insulation. There is a danger that during the assembly process, static electricity may be imparted to the traces and thereby damage the transducer head when they are mechanically and electrically connected. When the traces come into contact with ground, the potential energy is discharged. The rate of discharge is very important to affecting damage to the head. Although an insulative cover layer would provide some protection to electrostatic discharge, the cost to implement such a cover layer is not justifiable.

DISCLOSURE OF THE INVENTION

An electrically conductive grounding unit is situated between the integrated lead suspension and the tool block which is used to assemble it to the transducer head. The grounding unit grounds the uninsulated traces on the integrated lead suspension, thereby eliminating the danger of imparting static electricity to the transducer head during the assembly process. The grounding unit carries unwanted charges from the electrical traces on the suspension to the grounded tool block. The grounding unit is preferably fabricated from ceramic materials.

BEST MODE FOR CARRYING OUT THE INVENTION

Figure 1:
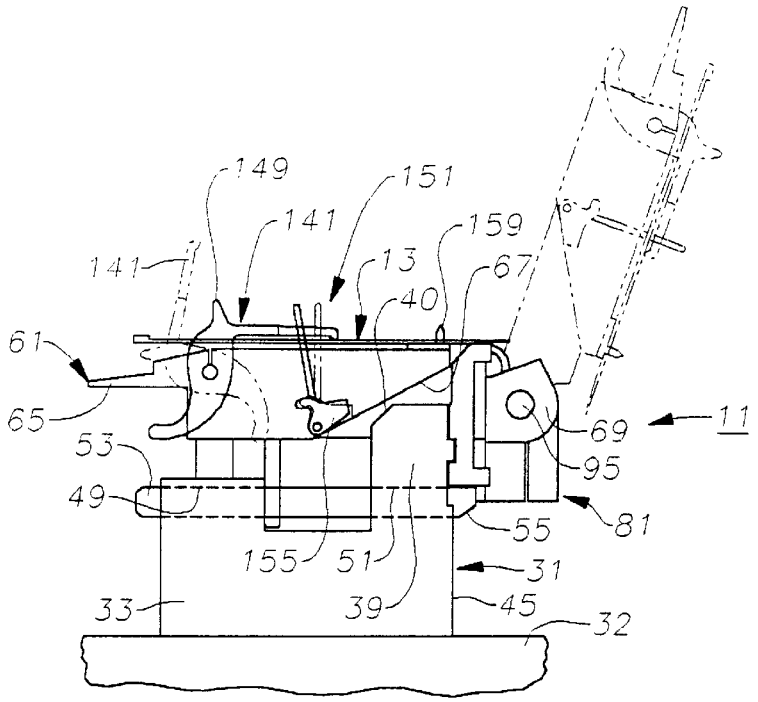
FIG. 1 is a side view of a tool block shown in both the open and closed positions.
Figure 2:
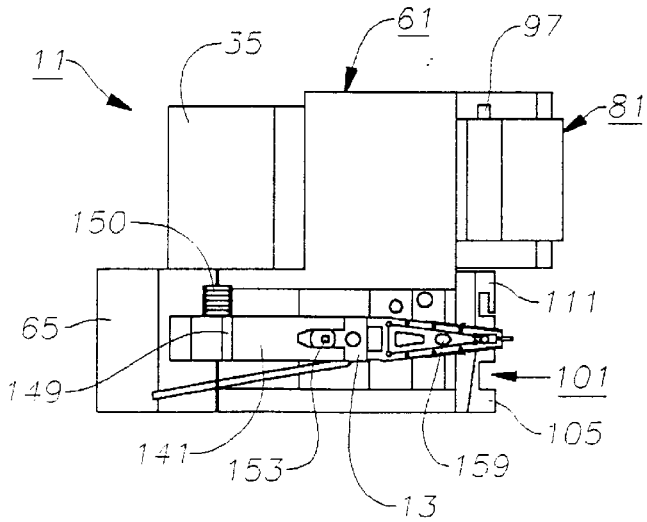
FIG. 2 is a top view of the tool block of FIG. 1 shown in the closed position.
Figure 3:
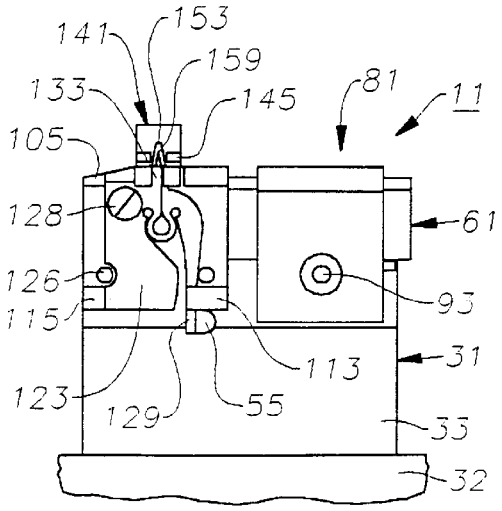
FIG. 3 is a front view of the tool block of FIG. 1 shown in the closed position.
Figure 11:
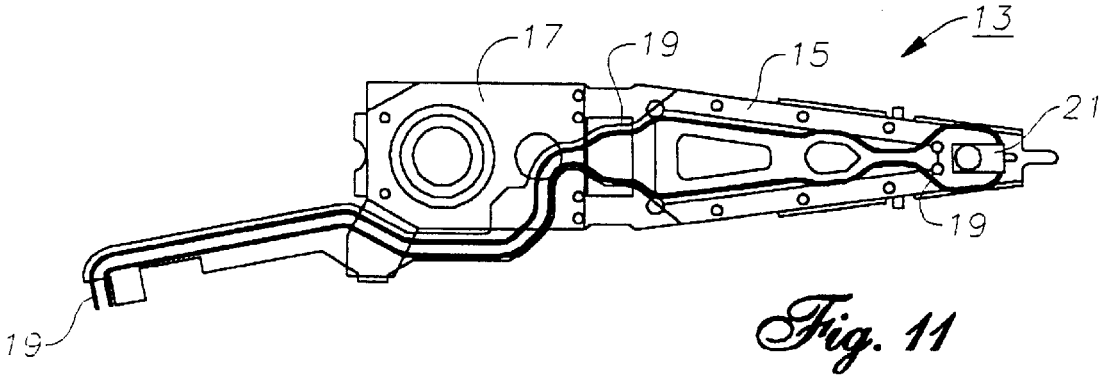
FIG. 11 is a bottom view of an integrated lead suspension assembly.

Referring to FIGS. 1–3, a tool block assembly 11 for processing an integrated lead suspension assembly 13 is shown. Suspension assembly 13 (FIG. 11) comprises a cantilevered suspension 15 secured to and extending from a suspension platform 17. Suspension assembly 13 also has a plurality of electrical leads 19 which extend along its length on a bottom surface. Leads 19 are uninsulated and are integrated directly into suspension 15. One end of each lead 19 is ultrasonically bonded to transducer heads or sliders 21 during assembly.

Tool block assembly 11 comprises a number of primary components which must be assembled prior to its use. The largest component is a tool block base 31 which is permanently mounted to a pallet 32 (FIGS. 1 and 3). Although pallet 32 is provided to facilitate the use of assembly 11 during automated manufacturing of suspension assemblies 13, assembly 11 may also be used in manual assembly procedures as well.

Figure 5:
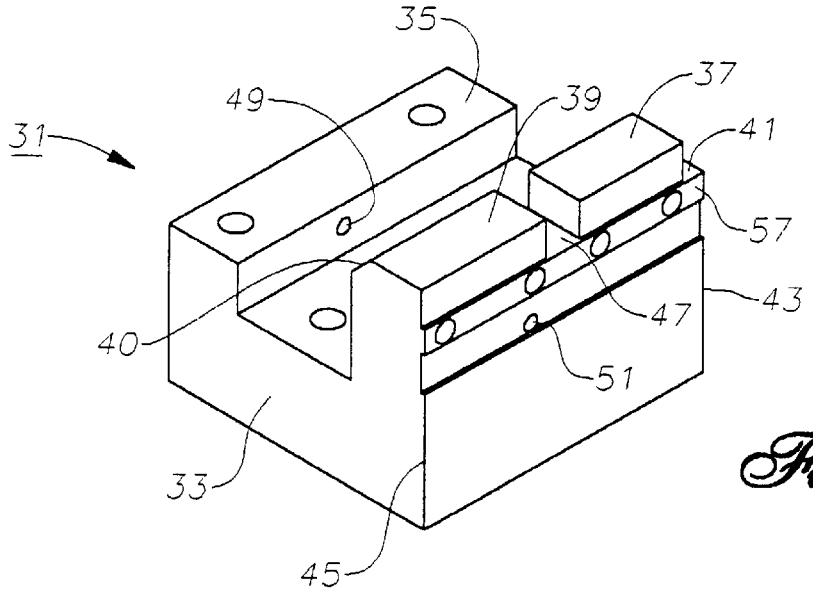
FIG. 5 is an isometric view of a base of the tool block of FIG. 1.

Referring to FIG. 5, base 31 is generally rectangular with a number of orthogonal features. A square lower portion 33 forms the foundation for base 31. A rectangular formation 35 extends upward from a rearward third of lower portion 33 along its rearward edge. Formation 35 has the same width as lower portion 33. Two castellations 37, 39 extend upward from a forward third of lower portion 33 along its forward edge. Castellations 37, 39 are asymmetrical and are each less than half the width of lower portion 33. Castellation 39 has a chamfer 40 on an upper rearward edge. A square notch 41 offsets castellation 37 from a side edge 43 of base 31. Castellation 39 is flush with an opposite side edge 45. A second square notch 47 separates castellations 37, 39 from each other. A pair of coaxial holes 49, 51 extend through formation 35 and castellation 39, respectively. As shown in FIG. 1, a round pin 53 having a chamfer 55 on a forward end extends through holes 49, 51 and protrudes from either end of base 31. A square rib 57 extends horizontally across the entire width of the forward surface of base 31.

Figure 4:
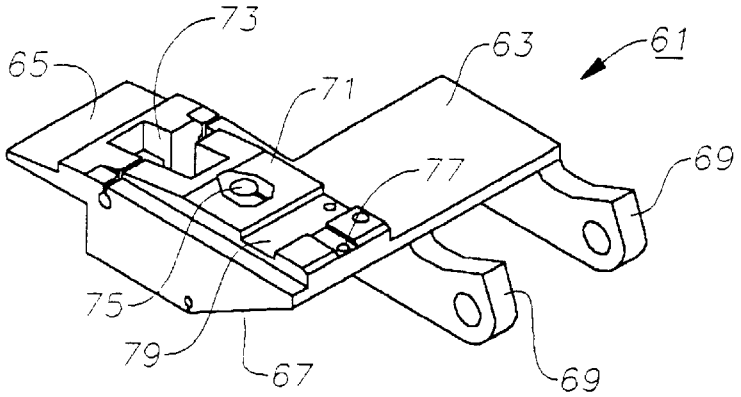
FIG. 4 is an isometric view of a pivot arm of the tool block of FIG. 1.

Referring to FIG. 4, a second major component of assembly 11 is pivot arm 61. Pivot arm 61 is a generally planar member with an L-shaped body 63 when viewed from above. Body 63 is generally trapezoidal when viewed from the side. A flat lift tab 65 extends horizontally rearward from body 63. A lower forward portion 67 is inclined at an approximately 30° angle and extends from a forward edge of body 63. A pair of vertical, flat fingers 69 extend symmetrically forward from one side of the forward edge of body 63. The opposite side of body 63 has a detailed raised platform 71 on an upper surface. A rectangular hole 73 is located in a rearward portion of platform 71 and extends downward completely through body 63. Platform 71 also has a centrally located round hole 75 and a round hole 77 at its forward edge. Holes 73, 75 and 77 are all centered and aligned with one another from front to back on platform 71. A shallow rectangular notch 79 separates holes 75 and 77 from one another.

Figure 6:
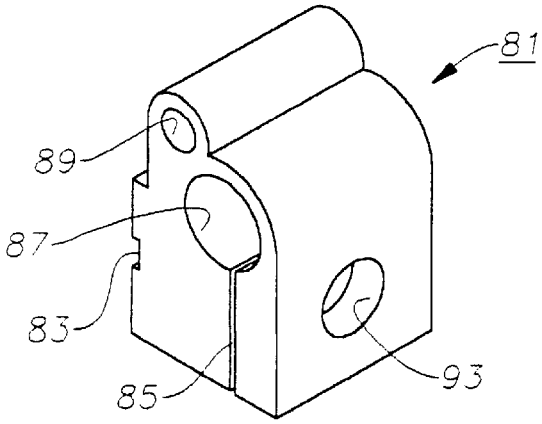
FIG. 6 is an isometric view of a pivot bracket of the tool block of FIG. 1.
Figure 7:
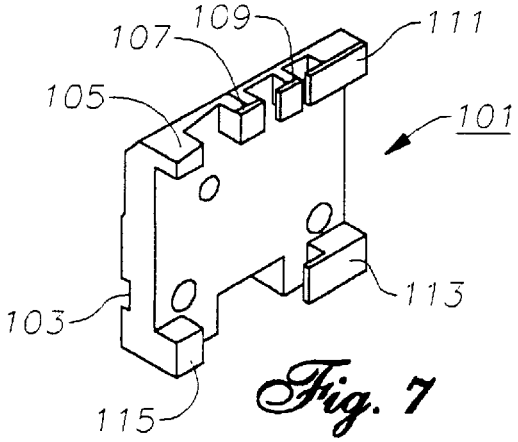
FIG. 7 is an isometric view of a mounting bracket of the tool block of FIG. 1.

Referring now to FIGS. 1 and 6, pivot arm 61 is attached to base 31 through pivot bracket 81. Like the other components, pivot bracket 81 is generally rectangular but has a rounded upper end. A square recess 83 extends horizontally across a backside of pivot bracket 81 and is provided for aligning with and engaging square rib 57 on base 31. Pivot bracket is split along a vertical slot 85 which intersects a large transverse hole 87. Another transverse hole 89 is located above, rearward and parallel to hole 87. A third hole 91 is longitudinal and is provided for receiving a fastener 93 (FIG. 3) for securing pivot bracket 81 to base 31. As shown in FIGS. 1 and 2, pivot arm 61 is pivotally joined to pivot bracket 81 by inserting a pin 95 through fingers 69 and hole 87. When a spring-biased pin 97 is mounted in hole 87, pivot arm 61 may be pivoted and locked from movement in either its horizontal position (FIGS. 1–3), or in its raised position (indicated by phantom lines in FIG. 1). Pivot arm 61 pivots approximately 110° between its horizontal (closed) and raised (open) positions.

As shown in FIGS. 1–3 and 7, assembly 11 also comprises a mounting bracket 101. Mounting bracket 101 is a generally rectangular, vertical member which fastens to a front surface of castellation 39 and body 33. Like pivot bracket 81, mounting bracket 101 has a square recess 103 which extends horizontally across its backside for aligning with and engaging square rib 57 on base 31. Mounting bracket 101 also has numerous short orthogonal protrusions 105, 107, 109, 111, 113, 115 which extend from forward surface adjacent to its upper and lower edges. Protrusions 105–115 are provided for precisely engaging a spring clamp 121 (FIG. 10), described below.

Figure 10:
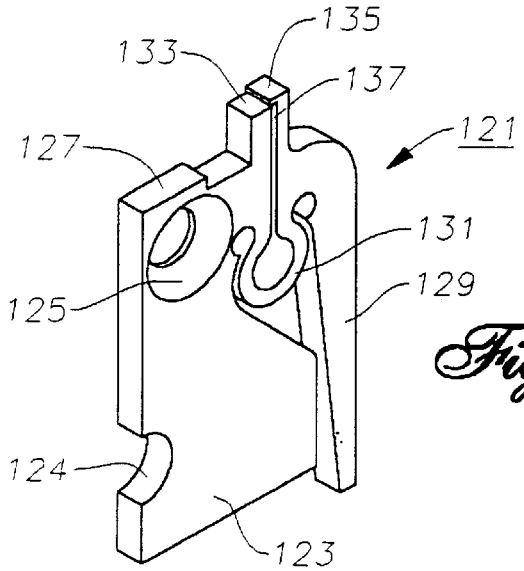
FIG. 10 is an isometric view of a spring clamp of the tool block of FIG. 1.

Referring now to FIG. 10, spring clamp 121 is a flat member with several S-shaped configurations. Spring clamp 121 has a generally planar body 123 with a notch 124 along a side edge for accommodating a fastener 126 (FIG. 3), and a through-hole 125 near its upper edge for a fastener 128. A raised square rib 127 protrudes from the upper edge of body 123 and is received between protrusions 105, 107 on mounting bracket 101. A long, downward-pointing tine 129 is located on an opposite side of body 123. Tine 129 has a vertical dimension which is slightly longer than and extends below body 123. Tine 129 is received by protrusion 113 on mounting bracket 101 and is designed to be engaged by chamfer 55 on pin 53 during operation. Tine 129 and body 123 are joined by a U-shaped member 131 which forms a pair of asymmetrical, upward-pointing tines 133, 135. Tines 133, 135 are separated by a vertical slot 137 and engage protrusions 107, 109 and 111 on mounting bracket 101.

Figure 8:
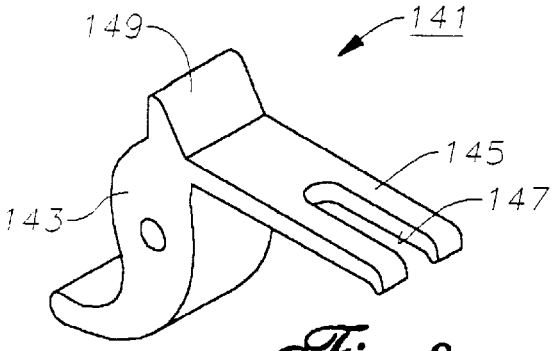
FIG. 8 is an isometric view of a platform clamp of the tool block of FIG. 1.

Referring to FIG. 8, a platform clamp 141 having a generally seahorse-shaped configuration when viewed from the side is shown. Platform clamp 141 has an S-shaped body 143 and a pair of symmetrical arms 145 which extend horizontally forward from body 143 and are separated by a U-slot 147. A trigger-type member 149 extends upward from body 143. Platform clamp 141 is pivotally mounted in rectangular hole 73 in pivot arm 61 so that it may be rotated approximately 90° in a vertical plane between a closed position (FIGS. 1–3) and an open position (indicated by phantom lines in FIG. 1). Platform clamp 141 is biased forward by a spring 150 (FIG. 2) which is located on its side in hole 73.

Figure 9:
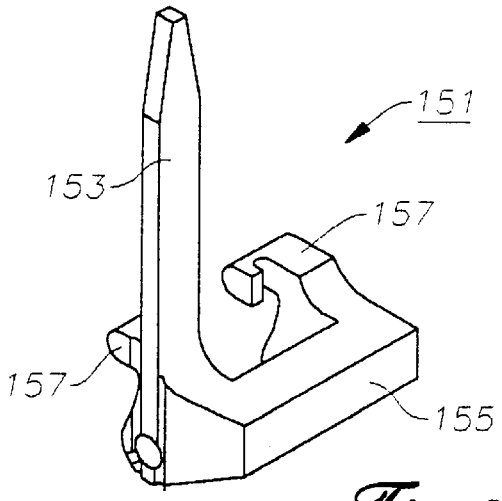
FIG. 9 is an isometric view of a pivot pin of the tool block of FIG. 1.

As shown in FIG. 9, a movable datum or pivot pin 151 has a pointed arm 153 extending upward from a generally rectangular body 155. Arm 153 is located to one side of body 155 while a pair of curved fingers 157 extend symmetrically rearward from body 155. Fingers 157 are provided for engaging an internal spring mechanism (not shown) in pivot arm 61. As shown in FIGS. 1–3, arm 153 extends upward through hole 75 when pivot pin 151 is mounted in pivot arm 61. Pivot pin 151 is biased to a slightly inclined position which is offset from vertical in a rearward direction by approximately 20° (FIG. 1). Pivot pin 151 may be pivoted to an upright vertical position (indicated by phantom lines in FIG. 1). A small pointed pin 159 is located adjacent to arm 153 in hole 77. Pin 159 extends upward from hole 77 and is fixed from movement.

Figure 13:
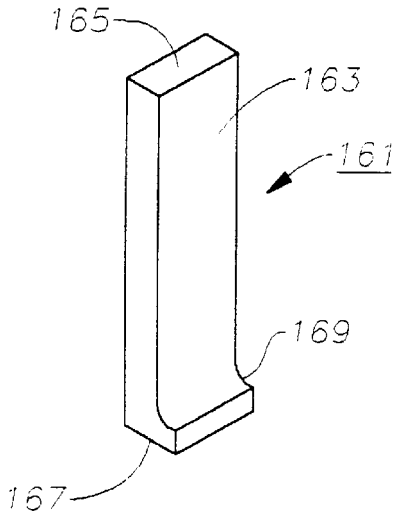
FIG. 13 is an isometric view of a grounding unit constructed in accordance with the invention.

Referring now to FIG. 13, a grounding unit 161 of the present invention is shown. Grounding unit 161 is a small monolithic structure having a flat rectangular body 163 with a top surface 165, a bottom surface 167, and a short, flat orthogonal flange 169 protruding from one side at a lower end. In the preferred embodiment, grounding unit 161 is formed from static dissipative ceramic zirconia, but may be formed from metallic, semiconductor, or plastic materials as well.

Figure 12:
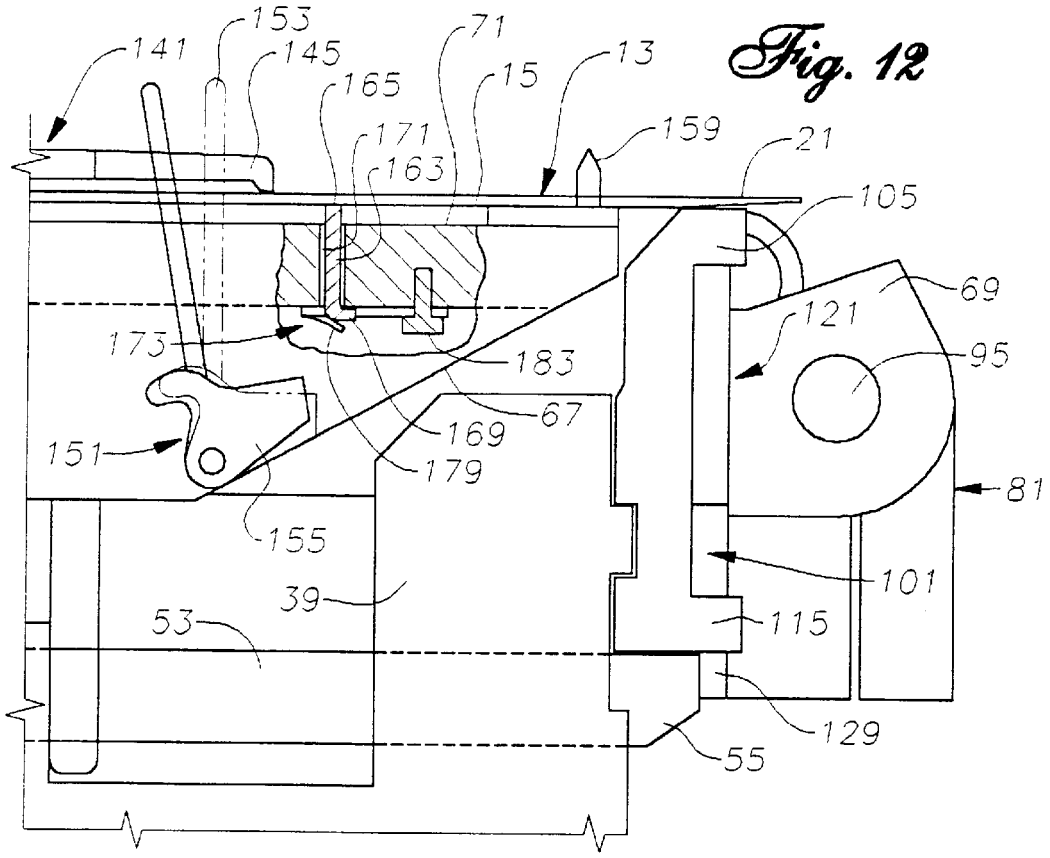
FIG. 12 is an enlarged sectional side view of a portion of the tool block of FIG. 1.

As shown in FIG. 12, grounding unit 161 is located inside a vertical rectangular hole 171 in pivot arm 61. Hole 171 is located between and longitudinally aligned with holes 73, 75. Hole 171 extends all the way through pivot arm 61, from platform 71 to its lower side. Hole 171 is only slightly larger than body 163 such that flange 169 extends below the lower surface of pivot arm 61.

Figure 14:
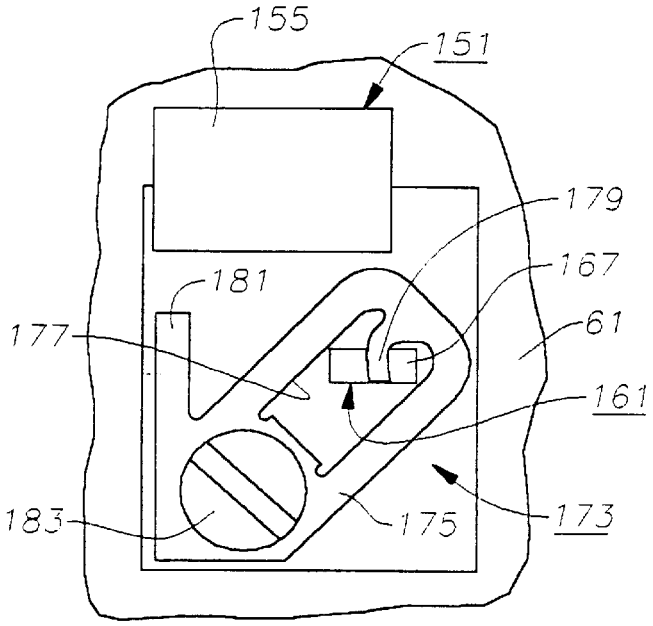
FIG. 14 is an enlarged bottom view of the grounding unit of FIG. 13 shown installed on the pivot arm of FIG. 4.

Referring to FIGS. 12 and 14, grounding unit 161 is retained in hole 171 by uniquely configured leaf spring 173. Spring 173 has a rounded rectangular body 175 with a central hole 177. A rounded tab 179 extends diagonally inward from one end of body 175. Tab 179 is precisely positioned to overlay bottom surface 167 of grounding unit 161. Tab 179 biases grounding unit 161 in an upward direction. Flange 169 prevents further upward movement of grounding unit 161 through hole 171. A linear tab 181 extends diagonally away from an opposite end of body 175. Spring 173 lies flat against the lower surface of pivot arm 61 and is held in place by a fastener 183.

In operation, tool block assembly 11 is assembled as described above prior to processing integrated lead suspension assemblies 13. If assembly 11 is to be used in automated procedures, pallet 32 is required for proper positioning and manipulation on a conveyor processing system (not shown).

Prior to receiving a suspension assembly 13, tool block assembly 11 is configured as shown by the solid lines in FIG. 1. Pivot clamp 141 is rotated counterclockwise to its open position (indicated by phantom lines in FIG. 1) and pin 53 is activated to the right. By actuating pin 53, arm 153 of pivot pin 151 is rotated clockwise (indicated by phantom lines in FIG. 1) to receive a suspension assembly 13 which is dropped or placed on platform 71 of pivot arm 61. As assembly 13 is placed on pivot arm 61, arm 153 of pivot pin 151 inserts through a hole in suspension platform 17 to precisely locate suspension assembly 13 in a lengthwise direction. Pivot clamp 141 is returned to the closed position (FIGS. 1–3) so that fingers 145 contact and hold suspension platform 17 against platform 71 and arm 153 is located in U-slot 147 of pivot clamp 141. Pin 53 is returned to the left position so that pivot pin 151 will overcome the clamping frictional force of clamp 141 and translate suspension 13 against datum pin 159. Pin 151 also serves to maintain angular alignment with respect to pin 159. Suspension assembly 13 is now flat against platform 71 for its entire length and the forward ends of leads 19 are perfectly positioned relative to tool block assembly 13. The combination of arm 153 and pin 159 provides high speed, automatic centering and positioning.

When pivot clamp 141 closes against suspension platform 17, the electrical leads 19 on the bottom of suspension assembly 13 are pressed against the top surface 165 of grounding unit 161 (FIG. 12). Spring 173 keeps grounding unit 161 biased against leads 19 over a short range of motion. As long as suspension assembly 13 is loaded in tool block assembly 11, its leads 19 will be electrically discharged through grounding unit 161.

With suspension assembly 13 securely and precisely located in tool block assembly 13, spring pin 97 (FIG. 2) is depressed so that pivot arm 61 may be released and pivoted 110° to its engagement position (indicated by phantom lines in FIG. 1). After pivot arm 61 reaches the engagement position, spring pin 97 pops out on the opposite side of fingers 69 to lock it in that position. The obtuse angle of the pivot arm 61 enables automation features to be located just above the tool block assembly 13 for head 21. Head 21 is then loaded in the tool block assembly by placing at the tip of slot 137 between tines 133, 135. Pin 53 is actuated forward so that its chamfer 55 compresses the lower end of tine 129 on spring clamp 121. Compression of tine 129 opens U-member 131 and, thus slot 137 so that head 21 may be received between tines 133, 135. Pin 53 is then retracted and tines 133, 135 close on head 21 to hold it in place. Adhesive is then applied to the backside of head 21. Pivot arm 61 is returned to its starting position by again depressing spring pin 97 so that fingers 69 are disengaged and may rotate downward. Spring pin 97 pops back out when pivot arm 61 is horizontal so that pivot arm 61 is again locked in place. As pivot arm 61 swings downward, head 21 is bonded to leads 19 to complete the precision assembly 13.

To remove completed suspension assembly 13 from tool block assembly 11, pin 53 is actuated to the right so pivot pin 151 will translate assembly 13 slightly forward to ensure that head 21 is free from spring clamp 121. Next, pivot clamp 141 is again pivoted to its open position (indicated by phantom lines in FIG. 1). Once in the forward position, assembly 13 can be safely removed from tool block assembly 11 without affecting pitch static attitude. This process is repeated for each integrated lead suspension assembly 13.

The invention has several advantages. The locating pins of the tool block accurately position the ILS and its electrical leads relative to the head to minimize resultant bending stress. The tool block is pelletized and designed for automated processing to enhance quality. The components of the tool block permit the ILS assembly to be safely removed from the tool block without affecting the PSA. In addition, the tool block may be fabricated by relatively inexpensive wire electronic discharge machining.

While the invention has been shown or described in only some of its forms, it should be apparent to those skilled in the art that it is not so limited, but is susceptible to various changes without departing from the scope of the invention.

We claim:

1. The method, further comprising the step of forming the grounding body from a semi-conductive material.

2. The apparatus of claim 1 wherein the grounding body has a protrusion for limiting movement of the grounding body through the hole in the base; and wherein an upper surface of the grounding body contacts the integrated electrical lead and the spring contacts a lower surface of the grounding body.

3. The apparatus of claim 1 wherein the grounding body is formed from a semi-conductive material.

4. The apparatus of claim 1 wherein the grounding body is a flat rectangular member having an orthogonal flange extending from a lower end.

5. The apparatus of claim I wherein the spring further comprises:

a leaf spring body having a central hole; and an inner tab extending from one end of the leaf spring body inward into the central hole for contacting the grounding body.

6. The apparatus of claim 5 wherein the spring further comprises an outer tab extending away from an opposite end of the leaf spring body.

7. The apparatus of claim 5 wherein the leaf spring body lies flat against one surface of the base and is secured to the base with a fastener; and wherein the grounding body protrudes from an opposite surface of the base.

8. An apparatus for processing an integrated lead suspension having a suspension body and at least one integrated electrical lead extending across the suspension body for connection to a slider, comprising:

a base;

an arm pivotally mounted to the base and having a platform on an upper surface for receiving the suspension body;

a grounding body formed from an electrically conductive material and slidably mounted in a hole in the arm, the grounding body having an upper surface for contacting the integrated electrical lead above the platform while the suspension body is located on the platform, and a protrusion on a lower end for limiting upward movement of the grounding body through the hole in the arm; and a spring mounted to a lower surface of the arm adjacent to the hole in the arm for contacting a lower surface of the grounding body and urging the upper surface of the grounding body against the integrated electrical lead of the integrated lead suspension for protecting the slider against electrostatic discharge.

9. The apparatus of claim 8 wherein the grounding body is formed from a semi-conductive material.

10. The apparatus of claim 8 wherein the grounding body is a flat rectangular member and wherein the protrusion is an orthogonal flange extending from a lower end of the grounding body.

11. The apparatus of claim 8 wherein the spring further comprises:

a leaf spring body having a central hole; and an inner tab extending from one end of the leaf spring body inward into the central hole for contacting the lower surface of the grounding body.

12. The apparatus of claim 11 wherein the spring further comprises an outer tab extending away from an opposite end of the leaf spring body for contacting the lower surface of the arm.

13. The apparatus of claim 11 wherein the leaf spring body lies flat against the lower surface of the arm and the inner tab is flexed away from the lower surface of the arm by the grounding body; and wherein an upper end of the grounding body protrudes from the hole in the arm above the platform.

14. A method for processing an integrated lead suspension having a suspension body and at least one integrated electrical lead extending across the suspension body for connection to a slider, comprising:

(a) mounting the suspension body on an upper surface platform of a base;

(b) contacting the integrated electrical lead above the platform with an upper surface of a grounding body which is slidably mounted in a hole in the base;

(c) contacting a lower surface of the grounding body with a spring which is mounted to a lower surface of the base such that the upper surface of the grounding body is biased against and contacts the integrated electrical lead while the suspension body is mounted on the upper surface platform for protecting the slider against electrostatic discharge.

15. The method of claim 14, further comprising the step of limiting upward movement of the grounding body through the hole in the arm with a protrusion on a lower end of the grounding body.

16. The method of claim 14, further comprising the step of forming the grounding body from a semi-conductive material.

* * * * *

UNITED STATES PATENT AND TRADEMARK OFFICE

CERTIFICATE OF CORRECTION

PATENT NO. : 5,959,827
DATED : September 28, 1999
INVENTOR(S) : Smith et al.

It is certified that error appears in the above-identified patent and that said Letters Patent is hereby corrected as shown below:

Column 5,
Line 52, delete Claim 1 which reads "The method, further comprising the step of forming the ground body from a semi-conductive material." and replace it with:

-- 1. An apparatus for processing an integrated lead suspension having a suspension body and at least one integrated electrical lead extending across the suspension body for connection to a slider, comprising:

a base having a platform for receiving the suspension body;

a grounding body formed from an electrically conductive material and slidably mounted in a hole in the base for contacting the integrated electrical lead while the suspension body is located on the platform; and a spring mounted to the base adjacent to the hole in the base for contacting and urging the grounding body against the integrated electrical lead of the integrated lead suspension for protecting the slider against electrostatic discharge. --

Signed and Sealed this

Twenty-fifth Day of June, 2002

*Attest:*

*Attesting Officer*

JAMES E. ROGAN
*Director of the United States Patent and Trademark Office*